US005989175A

United States Patent [19]

Kawanishi

[11] Patent Number: 5,989,175

[45] **Date of Patent: *Nov. 23, 1999**

[54] METHOD AND APPARATUS FOR CONVEYING SHEET ETC. FOR A FOLDING MACHINE

[75] Inventor: Masao Kawanishi, Mihara, Japan

[73] Assignee: Mitsubishi Jukogyo Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/752,590

[22] Filed: Nov. 21, 1996

[30] Foreign Application Priority Data

May 16, 1996 [JP] Japan ..... 8-121506

[51] Int. Cl.[6] ..... B65H 45/18

[52] U.S. Cl. ..... 493/437; 493/444; 271/273

[58] Field of Search ..... 493/417, 437, 493/444, 445, 29, 34, 442; 271/245, 246, 270, 273

[56] References Cited

U.S. PATENT DOCUMENTS

| | | | |
|---|---|---|---|
| 4,093,206 | 6/1978 | Hartmann | 493/444 |
| 4,175,740 | 11/1979 | Klenk | 270/83 |
| 4,281,828 | 8/1981 | McDonald | 493/437 |
| 4,746,108 | 5/1988 | Hirayama | 493/437 |
| 4,840,609 | 6/1989 | Jones | 493/444 |
| 5,222,934 | 6/1993 | Ochsner | 493/437 |

FOREIGN PATENT DOCUMENTS

| | | | |
|---|---|---|---|
| 90 05 227 U | 4/1990 | Germany . | |
| 91 16 314 U | 5/1991 | Germany . | |
| 60-6561 | 1/1985 | Japan . | |
| 63-242851 | 10/1988 | Japan . | |
| 0111374 | 5/1991 | Japan | 493/444 |
| 7-508701 | 9/1995 | Japan . | |

*Primary Examiner*—Jack W. Lavinder

*Attorney, Agent, or Firm*—Michael N. Meller; Eugene Lieberstein

[57] ABSTRACT

In the present invention, when a signature is formed with a chopper folding device, the conveying force of a sheet etc. conveyed to a position for sheet positioning is reduced, and the sheet etc. is released from restraint of the conveying force, by which the effect of the conveying force is not brought to the subsequent sheet folding process, so that a signature can be formed smoothly and properly.

4 Claims, 6 Drawing Sheets

METHOD AND APPARATUS FOR CONVEYING SHEET ETC. FOR A FOLDING MACHINE

FIELD OF THE INVENTION AND RELATED ART STATEMENT

The present invention relates to a method and apparatus for conveying a sheet etc. to a chopper folding section of a folding machine having a chopper folding device.

A conventional method and apparatus for conveying a sheet etc. will be described with reference to FIGS. 5 and 6. FIG. 5 shows an ordinary folding machine having a chopper folding device: FIG. 5(*a*) shows a whole configuration of a conveying apparatus etc., and FIG. 5(*b*) is a sectional view taken along the line A—A of FIG. 5(*a*), showing the details of the folding machine. FIG. 6 shows the operation of the chopper folding device shown in FIG. 5: FIG. 6(*a*) is a front view thereof, and FIG. 6(*b*) is a view in the direction of arrow B of FIG. 6(*a*).

For a folding machine for forming a signature by using a chopper folding device, an apparatus for conveying a sheet etc. 1 to a chopper folding section of a construction shown in FIG. 5 is usually used. The chopper folding device 3 comprises a sheet positioning stopper 2 for regulating the front end position of a sheet etc. 1 to be folded, a crank chopper 21, folding rollers 7*a* and 7*b*, an upper-side conveyor belt 10, consisting of a plurality of rows of belts, located over the sheet conveying line, and a lower-side conveyor belt 5, consisting of a plurality of rows of belts, located under the sheet conveying line, and so on.

The sheet positioning stopper 2, which is provided at gaps formed in the width direction of the upper-side conveyor belt 10 and the lower-side conveyor belt 5, serves to regulate the downstream end of a sheet etc. 1 by contacting with the front end of the sheet etc. 1 conveyed sequentially and to stop the sheet etc. 1 at a predetermined position of the chopper folding section.

The crank chopper 21, which comprises a chopper arm 23 swinging around a support shaft 22 and a plate-shaped chopper blade 6 fixed to the swinging end of the chopper arm 23, is configured so that the blade 6 is swung by turning the chopper arm 23 using a rotation drive means, not shown.

The folding rollers consist of two sets of rollers 7*a* and 7*b* arranged in the width direction of the conveyor belts 10 and 5 at a position corresponding to the blade 6 of the crank chopper 21 under the sheet conveying line. The rollers 7*a* and 7*b* are controlled so as to be rotated synchronously in the opposite direction at a predetermined circumferential speed.

The upper-side conveyor belt 10 and the lower-side conveyor belts 5, which are endless belts configured so as to run while passing around a plurality of guide pulleys 11 including respective driving pulleys, are controlled so that the belt portions engaging with each other over and under the sheet path line run synchronously in the same direction (arrow-marked direction in the figure).

A so-called sheet etc. 1 such as a sheet or a signature conveyed from the preceding process, not shown, to the folding machine configured as described above is fed between the upper-side conveyor belt 10 and the lower-side conveyor belt 5 as indicated by the arrow mark in the figure, and then conveyed to the downstream chopper folding section by the rotation of the conveyor belts 10 and 5 while being held between both the conveyor belts 10 and 5. The sheet etc. 1 advances further, and is folded by the chopper blade 6 brought down at a predetermined timing just before the front end of the sheet etc. 1 comes in contact with the sheet positioning stopper 2, being sent between the folding rollers 7*a* and 7*b* positioned below.

The chopper blade 6 rises just after the sheet etc. 1 is transferred, returning to a predetermined position to wait for the next sheet etc. 1. the sheet etc. 1 transferred between the folding rollers 7*a* and 7*b* is sent to the downstream process by the rotation of the rollers 7*a* and 7*b* while being held between the rollers 7*a* and 7*b*.

In the above-described conventional apparatus, the chopper folding device 3 frequently presents problems described below. When a signature is formed on the chopper folding device 3 as shown in FIG. 6, the chopper blade 6 is lowered just before the sheet etc. 1 being compulsorily conveyed hits the stopper 2.

Therefore, while the folded edge of a signature is lowered by the chopper blade 6, the portion held between the upper-side conveyor belt 10 and the lower-side conveyor belt 5 is pushed in the belt conveying direction. For this reason, the front upper end (S in the figure) of the sheet etc. 1 strongly hits the sheet positioning stopper 2 by a rotational force M, so that folding deformation or paper tear occurs, or the signature is transferred while being inclined frontward as shown in FIG. 6, possibly causing poor folding accuracy.

These defects remarkably degrade the signature quality and are responsible for the occurrence of troubles in folding and arranging operations in the downstream process.

OBJECT AND SUMMARY OF THE INVENTION

The present invention was made to solve the various problems with the conventional method and apparatus, and an object thereof is to provide a method and apparatus for conveying a sheet etc. for a folding machine, which operates reliably and properly and whose operation is stable without the occurrence of troubles unnecessary in the subsequent process.

To achieve the above object, the present invention provides a method for conveying a sheet etc. for a folding machine, in which when a signature is formed with a chopper folding device, the sheet etc. is conveyed to a position of a sheet positioning stopper for chopper folding, and when the sheet etc. comes in contact with the stopper or comes to a predetermined position just before the contacting, the conveying force of the sheet etc. is reduced to form a signature. The sheet etc. having conveyed on a predetermined route is brought into contact with the sheet positioning stopper or further conveyed to a position just before the contacting to advance to a chopper folding process. At this position, the conveying force is reduced suddenly to release the sheet etc. from the restraint of the conveying force, so that a signature can be formed in the condition in which the sheet etc. is not affected by the conveying force.

Also, the present invention provides an apparatus for conveying a sheet etc. for a folding machine which forms a signature with a chopper folding device, comprising a sheet positioning stopper for chopper folding, a chopper device for folding the sheet etc., and upper- and lower-side conveyor belts for holding and conveying the sheet etc., in which the upper-side conveyor belt is formed by an endless toothed belt having a length with integral multiple of a sheet etc. feed pitch, and the outside surface of the upper-side conveyor belt is provided with protrusions with a sheet etc. feed pitch. The sheet etc. is conveyed to a chopper folding section while only the front end of the sheet etc. is held between the protrusion on the upper-side conveyor belt and the lower-side conveyor belt. After the sheet etc. comes in contact with a chopper blade, which is lowered just before the front end of the sheet etc. comes in contact with the positioning stopper, or the stopper, the sheet etc. having been held between the protrusion of the upper-side conveyor belt and the lower-side conveyor belt slips by the resistance of the chopper blade or the stopper and is released from the holding, so that the sheet etc. is conveyed by only the frictional resistance with the surface of the lower-side conveyor belt. Thereupon, the chopper blade can apply a downward bending force to the sheet etc. which is scarcely subjected to the conveying force, so that a signature can be formed accurately.

Further, the present invention provides an apparatus for conveying a sheet etc. for a folding machine which forms a signature with a chopper folding device, comprising a sheet positioning stopper for chopper folding, a chopper device for folding the sheet etc., and upper- and lower-side conveyor belts for holding and conveying the sheet etc., in which the upper-side conveyor belt is formed by a flat endless belt, and there is provided a moving device which elevates a part of the upper-side conveyor belt at the chopper folding position at a predetermined timing just before the sheet etc. comes in contact with the stopper to form a gap between the upper-side conveyor belt and the lower-side conveyor belt. After the sheet etc. is conveyed to the chopper folding device by the running of the conveyor belts while being held between the upper-side conveyor belt and the lower-side conveyor belt, the upper-side conveyor belt is raised at a predetermined position (timing) just before the front end of the sheet etc. comes in contact with the sheet positioning stopper to release the force holding the sheet etc., so that the sheet etc. is conveyed by only the frictional resistance with the surface of the lower-side conveyor belt. Thereupon, like the above-described mode of the invention, the chopper blade applies a bending force to the sheet etc. released from the conveying force, so that a signature can be formed accurately.

Thus, according to the present invention, the sheet conveying force is reduced to the utmost from a predetermined position where the sheet etc. comes in contact with the sheet positioning stopper on the downstream side of the chopper folding section or just before the contacting, so that accuracy can be increased significantly in folding.

Also, the apparatus in accordance with the present invention prevents a sheet corner from hitting the stopper or the sheet etc. from being torn or damaged, so that a well-ordered signature can be obtained. The sheet conveying force of the lower-side conveyor belt remaining slightly after the holding force of the upper- and lower-side conveyor belts is released has a function of bringing the sheet etc. in contact with the positioning stopper accurately and stably, so that the oblique running of the sheet etc. is corrected, and the positional accuracy in chopper folding can be increased.

As described above, according to the present invention, the conveying force of the sheet etc. is reduced at a predetermined timing when the sheet etc. having been conveyed comes in contact with the sheet positioning stopper in the chopper folding device or just before the contacting, by which the sheet etc. is released from the restraint of conveying force, and the subsequent process can be conducted smoothly and stably.

Therefore, the striking of the sheet front end and the its strong hit to the stopper can be prevented, so that paper deformation and paper tear are eliminated, and the folding accuracy can be increased significantly. Thereupon, the folding quality is upgraded, and the commercial value is enhanced. Also, in the operations in the downstream process, such as next folding and arranging operations, troubles such as arrangement in disorder caused by tear or deformation and poor accuracy in the next process are eliminated. Further, the machine downtime caused by adjustment for correcting the troubles can be shortened. Thus, various effects such as labor saving and improvement in rate of operation or productivity can be achieved.

According to the invention of claim 2, the aforementioned reduction in sheet conveying force is achieved by the upper-side conveyor belt on which protrusions are provided at intervals of feed pitch of the sheet etc., so that the initial aim can be accomplished by a very simple device configuration.

According to the invention of claim 3, the aforementioned reduction in sheet conveying force is achieved by raising a part of the upper-side conveyor belt at the chopper folding position to form a gap between the upper- and lower-side conveyor belts, so that the initial aim can be achieved accurately and reliably by a very simple device configuration.

BRIEF DESCRIPTION OF THE DRAWINGS

FIG. 1(*a*) shows a whole configuration of the conveying apparatus, and FIG. 1(*b*) shows the details of the F portion of FIG. 1(*a*);

FIGS. 4(*a*), 4(*b*), and 4(*c*) show different modifications of the pulley elevating drive device, and FIG. 4(*d*) shows the details of the G portion of FIGS. 4(*a*), 4(*b*), and 4(*c*);

FIG. 5(*a*) shows a whole configuration of the conveying apparatus, and

FIG. 5(*b*) is a sectional view taken along the line A—A of FIG. 5(*a*)

FIG. 6(*a*) is a front view thereof, and

FIG. 6(*b*) is a view in the direction of arrow B of FIG. (*a*).

DETAILED DESCRIPTION OF PREFERRED EMBODIMENTS

Figure 1A:
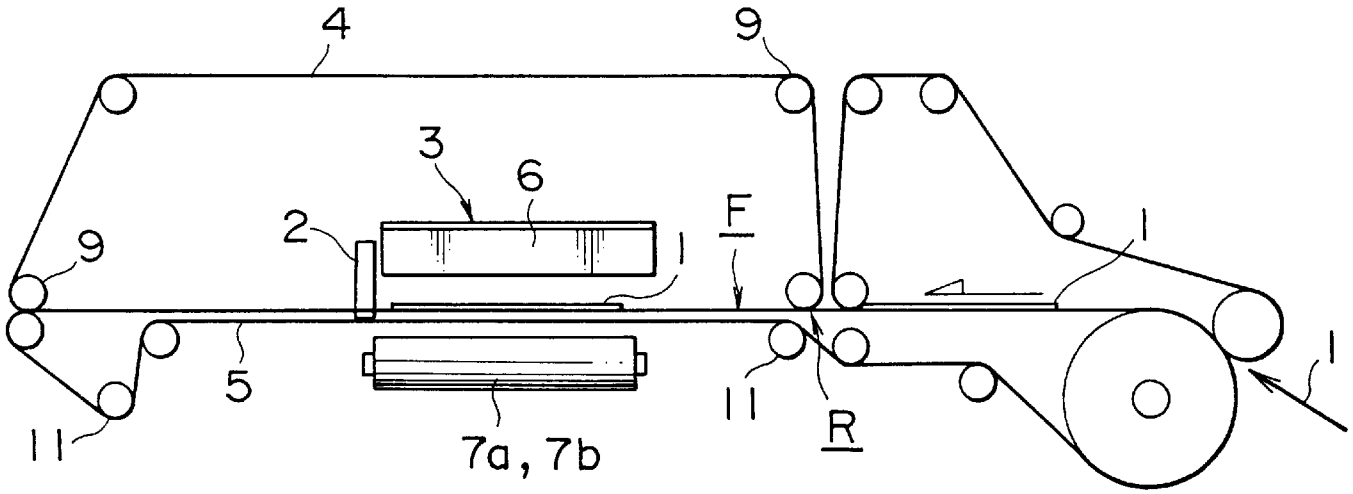
FIG. 1 is a schematic view of a sheet conveying apparatus in accordance with a first embodiment of the present invention.
Figure 1B:
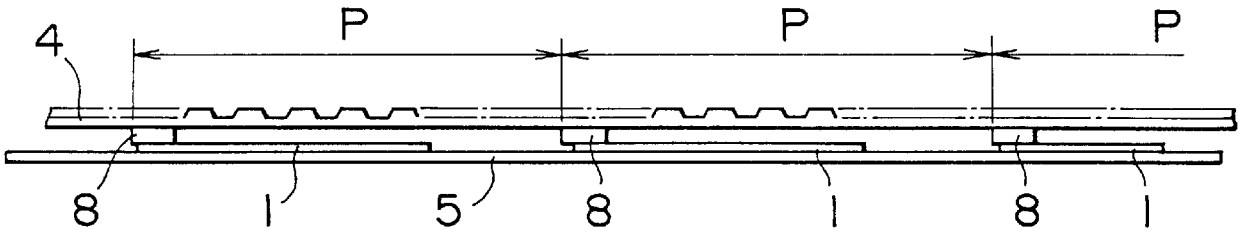

A first embodiment of the present invention will be described with reference to FIG. 1. FIG. 1 is a schematic view of a sheet conveying apparatus for a folding machine having a chopper folding device. FIG. 1(*a*) shows a whole configuration of the folding apparatus, and FIG. 1(*b*) is an enlarged view of the F portion indicated by the arrow in FIG. 1(*a*), which is a principal portion of the conveying apparatus. In this figure, the same reference numerals are applied to the same elements as those of the conventional apparatus, and duplicate explanation is omitted.

FIG. 1 shows a sheet conveying apparatus for a folding machine having a chopper folding device 3, which comprises a sheet positioning stopper 2 for regulating the chopper folding position of a sheet etc. 1, a chopper folding device 3 for folding the sheet etc. 1, and upper- and lower-side conveyor belts 4 and 5 for conveying the sheet etc. 1 and so on. Also, a pair of folding rollers 7*a* and 7*b* disposed under the sheet conveying line at a position corresponding to a chopper blade 6.

In this apparatus, the upper-side conveyor belt 4 is an endless toothed belt (endless timing belt) having an outside length l (l=P×n) with integral multiple n of a sheet feed pitch P, and protrusions 8 are provided at the sheet feed pitch P on the outside surface of the upper-side conveyor belt 4. Some of the protrusions 8 are formed by bonding or screwing felt, sponge, rubber, resin, etc. Alternatively, protrusions formed integrally with the belt and other various types of protrusions can be used. The protrusions 8 are formed so as to have a height exceeding the tooth height of the upper-side conveyor belt 4.

The upper-side conveyor belt 4, which is disposed by passing around a plurality of sets of toothed timing pulleys 9, is controlled so as to run together with the lower-side conveyor belt 5 at a predetermined speed (timing) in association with the machine speed. The lower-side conveyor belt 5 is formed by a flat belt; however, it may be formed by a timing belt like the upper-side conveyor belt 4.

Since this embodiment is configured as described above, the front end of a sheet etc. 1 fed from the preceding process is held between the protrusion 8 on the upper-side conveyor belt 4 and the upper surface of the lower-side conveyor belt 5 at the R portion in FIG. 1, and the sheet etc. 1 is conveyed to a chopper folding section of the chopper folding device 3.

The sheet etc. 1 advancing in the chopper folding section comes in contact with a chopper blade 6, which is lowered just before the first front end of the sheet etc. 1 comes in contact with a sheet positioning stopper 2, or the stopper 2, and slips to be released from a state in which the sheet etc. 1 is held between the protrusion 8 and the lower-side conveyor belt 5, being released from holding.

Thereupon, the holding force of the upper-side conveyor belt 4 and the lower-side conveyor belt 5 disappears, resulting in a substantially free state of the sheet etc. 1. The sheet etc. 1 in this state is folded by the chopper blade 6 brought down from the upside, and transferred between the folding rollers 7*a* and 7*b* positioned below.

The sheet etc. 1 in the chopper folding section of this apparatus is formed into a signature in a substantially free state in which the sheet etc. 1 is scarcely subjected to an operating force in the advance direction, so that the corner S of the sheet etc. 1 does not hit the sheet positioning stopper 2, or the sheet etc. 1 is not torn or deformed by striking. Accordingly, the folding accuracy is increased significantly, producing proper signatures, the commercial value is enhanced, and troubles in the subsequent process are eliminated.

Figure 2:
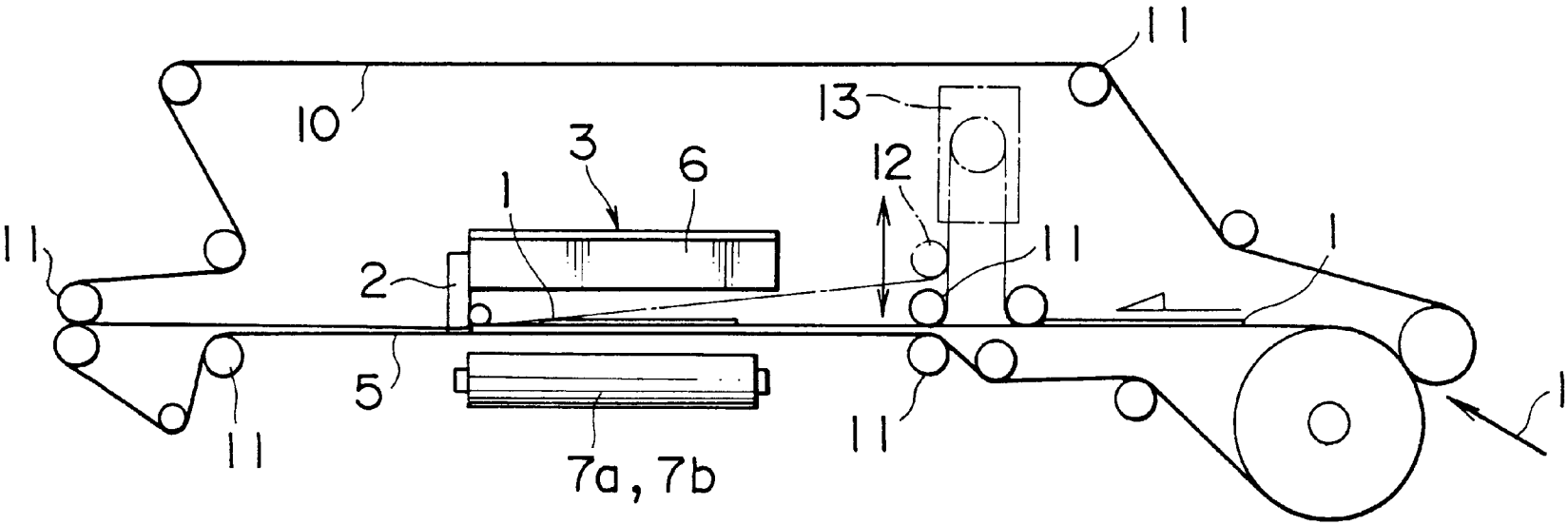
FIG. 2 is a schematic view of a sheet conveying apparatus in accordance with a second embodiment of the present invention.

Next, a second embodiment of the present invention will be described with reference to FIG. 2. In this figure, the same reference numerals are applied to the same elements as those of the conventional apparatus and the apparatus of the first embodiment, and duplicate explanation is omitted.

The sheet conveying apparatus of this embodiment comprises a sheet positioning stopper 2, a chopper folding device 3 for folding a sheet etc. 1, upper- and lower-side conveyor belts 10 and 5 for conveying the sheet etc. 1, folding rollers 7*a* and 7*b*, and so on.

This embodiment differs from the above-described first embodiment in that there are provided a pulley moving device 12 for vertically moving a guide pulley 11 which is positioned on the upstream side close to the chopper folding device 3 and around which the upper-side conveyor belt 10 passes and a tension adjusting device 13 for absorbing variations in belt tension caused by the vertical movement of the guide pulley 11, and in that the upper-side conveyor belt 10 is a flat belt without protrusions. The upper-side conveyor belt 10 and the lower-side conveyor belt 5 are controlled so as to run at a predetermined speed in association with the machine speed.

In this embodiment thus configured, the sheet etc. 1 fed from the preceding process is held between the upper-side conveyor belt 10 and the lower-side conveyor belt 5, and conveyed to a chopper folding section of the chopper folding device 3. Thereafter, at a predetermined timing when the front end of the sheet etc. 1 comes in contact with the sheet positioning stopper 2, or just before the contacting, the pulley moving device 12 is operated to raise the guide pulley 11, by which a predetermined gap is formed between a part of the upper-side conveyor belt 10 and the lower-side conveyor belt 5.

Thereupon, the holding force of the upper-side conveyor belt 10 and the lower-side conveyor belt 5 disappears, resulting in a substantially free state of the sheet etc. 1. Therefore, the sheet etc. 1 hits the sheet positioning stopper 2 by only the frictional resistance with the lower-side conveyor belt 5, or is transferred just before hitting the stopper 2. The sheet etc. 1 in this state is folded by the operation of the chopper blade 6 brought down from the upside, and transferred between the folding rollers 7*a* and 7*b* positioned below.

In this embodiment as well, the sheet etc. 1 in the chopper folding device 3 is formed into a signature in a substantially free state in which the sheet etc. 1 is scarcely subjected to an operating force in the advance direction, so that the same effects as those of the above-described first embodiment can be achieved.

Figure 3:
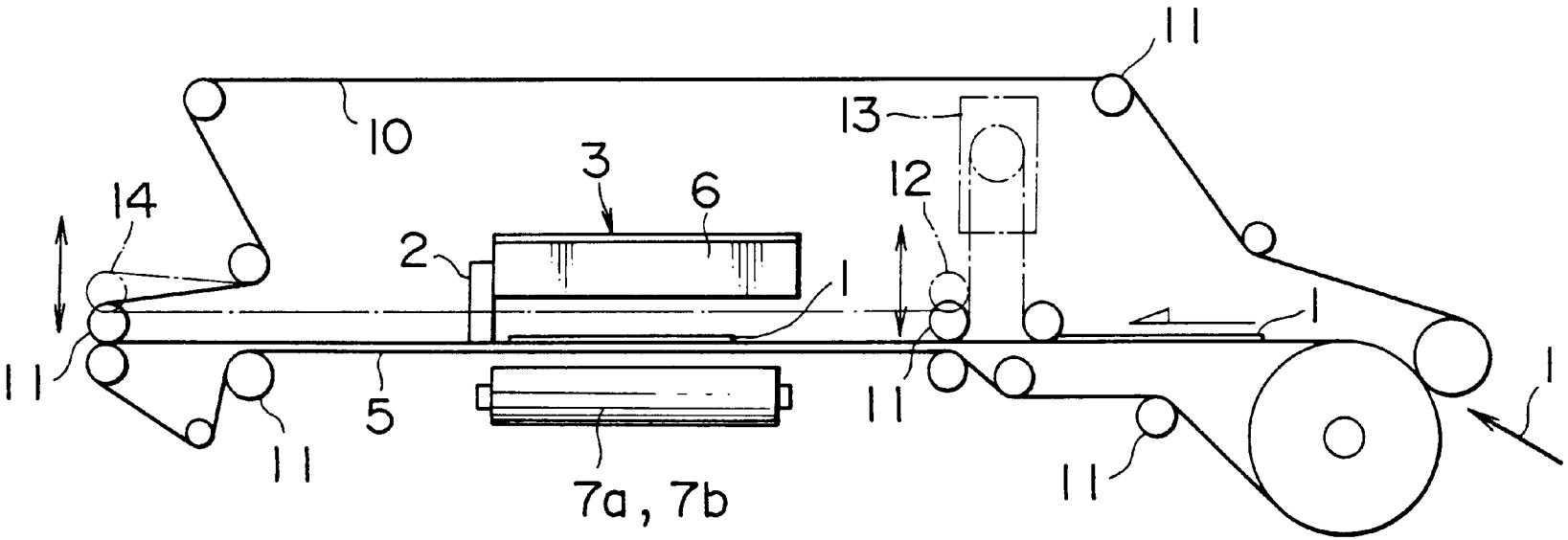
FIG. 3 is a schematic view of a sheet conveying apparatus in accordance with a third embodiment of the present invention.
Figure 4A:
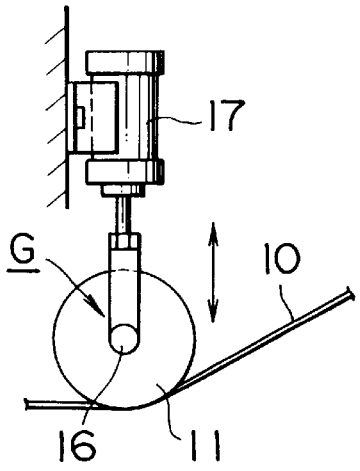
FIG. 4 shows a pulley elevating drive device which can be employed for the apparatuses shown in FIGS. 2 and 3.
Figure 4B:
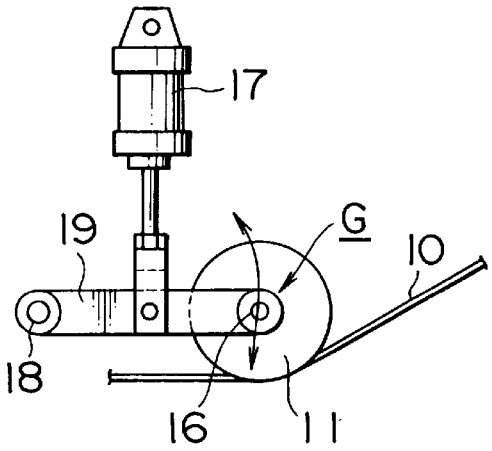
Figure 4C:
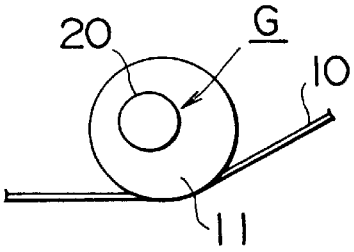
Figure 4D:
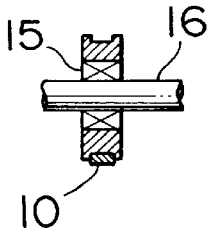
Figure 5A:
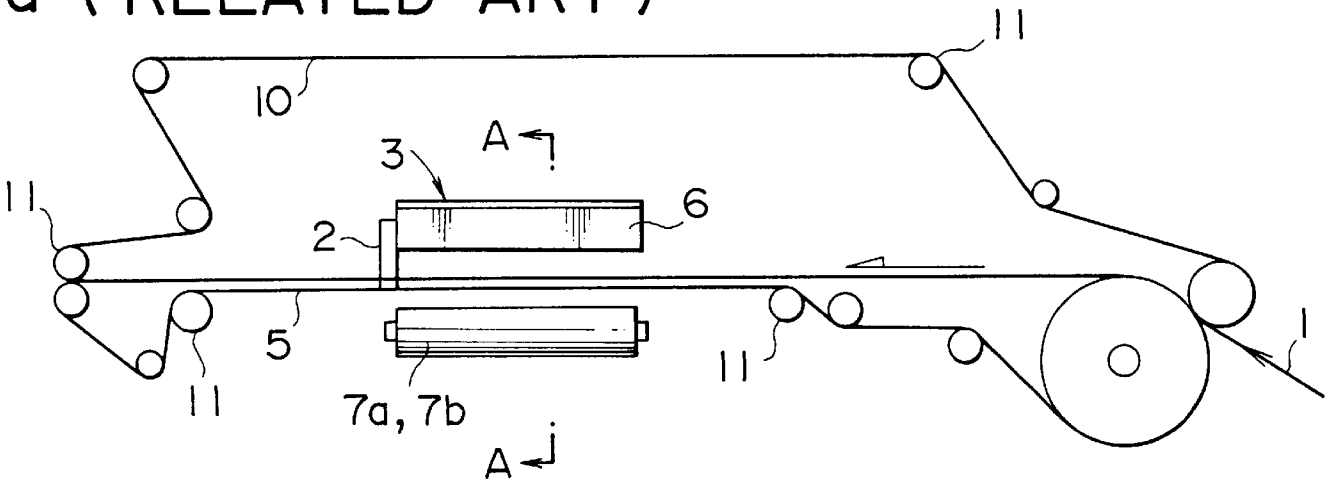
FIG. 5a (RELATED ART)
FIG. 5 is a schematic view of a sheet conveying apparatus for a conventional ordinary folding machine.
Figure 5B:
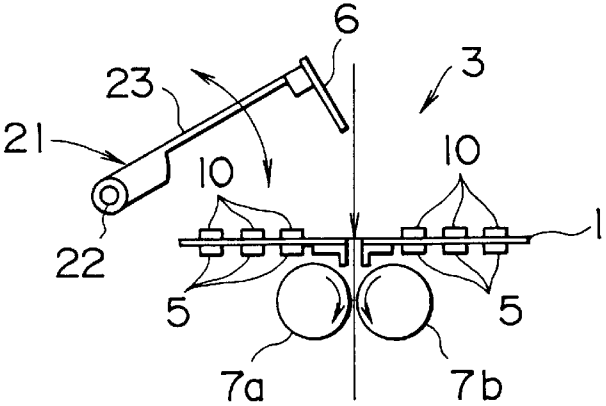
FIG. 5b (RELATED ART)
Figure 6A:
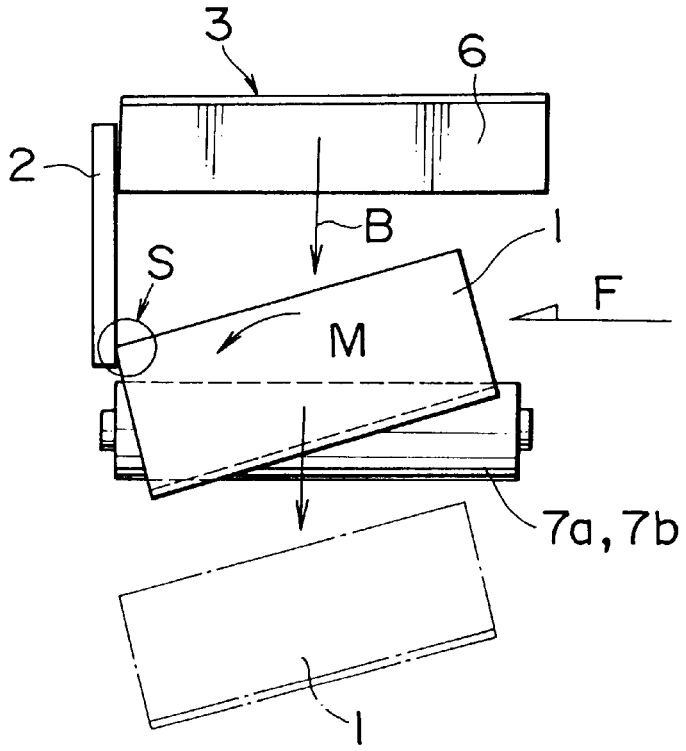
FIG. 6a RELATED ART
FIG. 6 shows the operation of a chopper folding device shown in FIG. 5.
Figure 6B:
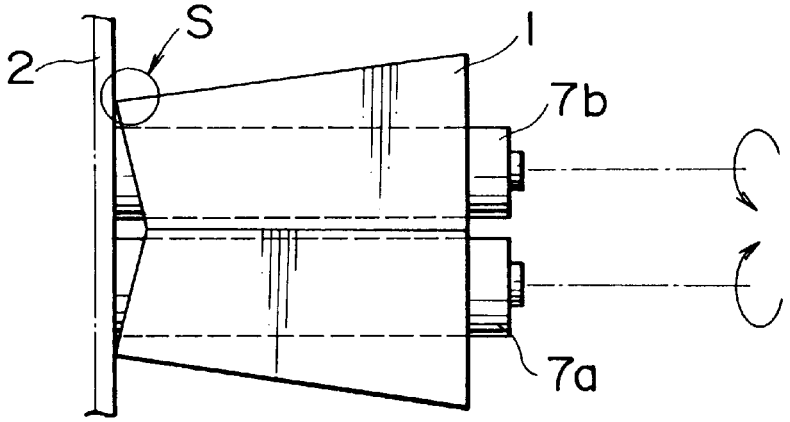
FIG. 6b RELATED ART

Next, a third embodiment of the present invention will be described with reference to FIG. 3. In this figure, the same reference numerals are applied to the same elements as those of the conventional apparatus and the apparatus of the first and second embodiments, and duplicate explanation is omitted.

The configuration of this embodiment is similar to that of the second embodiment. In addition to the configuration of the second embodiment, there is provided another pulley moving device 14 for vertically moving a guide pulley 11 which is positioned on the downstream side close to the chopper folding device 3 and around which the upper-side conveyor belt 10 passes.

Like the second embodiment, the upper-side conveyor belt 10 and the lower-side conveyor belt 5 are controlled so as to run at a predetermined speed in association with the machine speed.

In this embodiment thus configured, the sheet etc. 1 fed from the preceding process is held between the upper-side conveyor belt 10 and the lower-side conveyor belt 5, and conveyed to a chopper folding section of the chopper folding device 3. The pulley moving devices 12 and 14 are operated at the same timing as that of the second embodiment, and the force holding the sheet etc. 1 exerted by the upper-side conveyor belt 10 and the lower-side conveyor belt 5 can be released more reliably than the second embodiment.

It is preferable that the upstream-side pulley moving device 12 and the downstream-side pulley moving device 14 operate synchronously, but the configuration is not limited to this. These pulley moving devices may be operated individually with a predetermined time lag.

In this embodiment and the above-described second embodiment, the guide pulleys 11 are raised by the pulley moving devices 14 and 12 to move the upper-side conveyor belt 10. Some modifications of the elevating drive means for the pulley moving device are shown in FIG. 4.

In FIG. 4(*a*), a plurality of guide pulleys 11 disposed so as to correspond to a plurality of divided pieces of the upper-side conveyor belt 10 are supported by a shaft 16 pivotally mounted in parallel via a bearing 15 shown in FIG. 4(*d*), both ends of the shaft 16 being connected to a head portion of a cylinder 17. This means can vertically move the guide pulley 11 group linearly via the synchronous extending/retracting operation of the cylinders 17, 17.

In FIG. 4(*b*), a plurality of guide pulleys 11, which are the same as those of the above-described means, are supported by a shaft 16 pivotally mounted in parallel via a bearing 15, both ends of the shaft 16 is connected to the front end of an arm 19 swinging around a support pin 18, and a cylinder 17 is installed at the intermediate position of the arm 19. This means can elevate the guide pulley 11 group by swinging via the synchronous extending/retracting operation of the cylinders 17, 17.

In FIG. 4(*c*), a plurality of guide pulleys 11 are supported by a shaft 20 pivotally mounted in parallel via a bearing 15 in an eccentric manner. This means can elevate the guide pulley 11 group by turning the eccentric shaft 20.

A variety of elevating drive means for the guide pulley 11 are available in addition to the shown ones. A method, in which the guide pulleys are fixed to the shaft 16 and the shaft 16 is pivotally mounted to the elevating drive means via a bearing, can also be used.

The construction and function of the present invention is as described above. The detailed construction etc. are not limited to the above-described embodiments. Various modifications can be made without departing from the spirit and scope of the present invention.

I claim:

1. A method for conveying a sheet in a sheet folding machine having:

a lower-side conveyor belt revolving in a first direction and an upper-side conveyor belt revolving in a second direction opposite to said first direction so as to convey a sheet held therebetween, said machine further having a sheet positioning stopper, a set of rollers adapted to receive a folded sheet therebetween; and a blade for folding the sheet by moving it between the rollers, said method comprising the steps of:

moving said sheet being conveyed by said conveyor belts with a preselected engaging force until said sheet arrives at a predetermined position, and substantially reducing said engaging force for holding said sheet between said belts after said sheet arrives at said predetermined position.

2. A method as claimed in claim 1 wherein said predetermined position is reached when said sheet contacts said sheet positioning stopper.

3. An apparatus for conveying a sheet in a sheet folding machine comprising:

a lower-side conveyor belt revolving in a first direction;

an upper-side conveyor belt revolving in a second direction opposite to said first direction adapted to convey a sheet held therebetween along a preselected path, wherein said upper-side conveyor belt is an endless loop belt revolving in a circuit defined by at least one guide pulley and wherein the spacing between said belts is adjustable by moving said guide pulley;

a sheet positioning stopper arranged along said preselected path;

a set of rollers arranged adjacent said preselected path adapted to receive a folded sheet;

a blade arranged adjacent said path and said rollers for folding said sheet by bringing it between said rollers, said belts conveying said sheet to a predetermined position along said path with an engaging force; and means for substantially reducing said engaging force when said sheet reachers said predetermined position, said means for substantially reducing said engaging force changes the spacing between the belts by moving said guide pulley when said sheet reaches said sheet positioning stopper.

4. An apparatus for conveying a sheet in a sheet folding machine comprising:

a lower-side conveyor belt revolving in a first direction;

an upper-side conveyor belt revolving in a second direction opposite to said first direction adapted to convey a sheet held therebetween along a preselected path, wherein said upper side conveyor belt is an endless loop belt revolving in a circuit defined by at least one guide pulley and wherein the spacing between said belts is adjustable by moving said guide pulley;

a sheet positioning stopper arranged along said preselected path;

a set of rollers arranged adjacent said preselected path adapted to receive a folded sheet;

a blade arranged adjacent said path and said rollers for folding said sheet by bringing it between said rollers, said belts conveying said sheet to a predetermined position along said path with an engaging force; and means for substantially reducing said engaging force when said sheet reaches said predetermined position, said means for substantially reducing said engaging force changes the spacing between said belts by moving said guide pulley when said sheet reaches said blade.

* * * * *